United States Patent [19]

Krickovich

[11] 4,164,820

[45] Aug. 21, 1979

[54] SNOW REMOVER AND VACUUM SWEEPER

[76] Inventor: Eli G. Krickovich, P.O. Box 106, Clinton, Iowa 52732

[21] Appl. No.: 899,513

[22] Filed: Apr. 24, 1978

[51] Int. Cl.[2] ..... E01H 5/10

[52] U.S. Cl. ..... 37/12; 15/340

[58] Field of Search ..... 15/340; 37/12, 13, 41

[56] References Cited

U.S. PATENT DOCUMENTS

| | | | |
|---|---|---|---|
| 1,742,968 | 1/1930 | Polak | 37/12 |
| 3,866,340 | 2/1975 | Krickovich | 37/12 |

*Primary Examiner*—Christopher K. Moore

[57] ABSTRACT

A fluid containing insulated tank is mounted on a vehicle chassis having an engine driving a hydraulic system and an electric energy generating unit. The roadway cleaning apparatus, including housing contained screw conveyors, is mounted transversely of the forward end of the vehicle chassis for discharging snow and roadway debris through discharge tubes into the tank through an inlet port opened and closed by a hydraulically operated inlet port opening and closing door. Electric resistance heaters, contained by the tank and mounted thereon, melts snow and heats fluid and air contained by the tank. An agitator within the tank forms a slurry of the contents.

9 Claims, 10 Drawing Figures

SNOW REMOVER AND VACUUM SWEEPER

BACKGROUND OF THE INVENTION

1. Field of the Invention

The present invention relates to snowplows and more particularly to snow and trash removal and disposal apparatus for streets, roadways, walks, runways, factory warehouse areas, or the like.

In removal of snow from streets and roadways it has been the practice, generally, to employ a snowplow or in some instances graders which remove the snow off the street into piles or rows which later must be picked up by a loader and disposed of by dump trucks. This type of operation is time consuming and expensive in man hours and necessary equipment and, besides, is a comparatively slow process of snow removal.

Furthermore, said apparatus represents a considerable monetary investment as it normally remains unused during the warm months of the year when other types of equipment, as street sweepers, are used for cleaning dirt, trash, etc. off streets and roadways.

It is desirable from an environment viewpoint to provide an apparatus for removing and melting snow and for cleaning up and disposing of dust, dirt, leaves or papers and other items commonly known as "trash" by immersion and mixing with water requiring heat for snow whereas none is needed for trash when the atmospheric temperature is above freezing.

Conventional street sweepers have a relatively small storage capacity and, therefore, similarly require the service of pickup and disposal units.

This invention simplifies the above steps of removing and disposing of snow by providing a single mobile machine which picks up the snow and melts it in an expedient ten, or as desired, dump truck load capacity insulated tank which is periodically drained into a storm sewer, or the like, thus eliminating the use of a loader and dump trucks as well as saving time and wear of such equipment by converting the snow to water as it is removed from the roadway. Draining the disposal tank continuously into the street gutter while picking up plowed snow alongside a street effects considerable efficiency. As snow is about 10 to 1 water, the above operation would only leave a small stream of water in the street gutter. Furthermore, since only above freezing temperature is required in the slurry which would be about 24 inches deep, the heat requirement could be provided for with maximum expediency.

It is also desirable from an investment standpoint that this device be capable of being modified and used as a sweeper and vacuum cleaner during the warm season or anytime of the year.

2. Description of the Prior Art

The most pertinent prior patent is my U.S. Pat. No. 3,766,586, which discloses a screw conveyor roadway cleaning means communicating with a receiving tank heated by a burner means and a rotating agitator for mixing materials deposited in the tank.

The principal distinction of this invention over my prior patent is providing an electric resistance heat exchanger which eliminates the expense and resultant air pollution of burning a fuel for heating the tank. This invention also provides air heating means for the tank and a street curb surface contacting and cleaning brush.

U.S. Pat. No. 3,201,819 discloses roller seals joined by end plates to minimize dust pollution of the atmosphere during a sweeping action and also discloses a laterally disposed wall contacting brush. This invention is distinctive over the last named patent by the manner of mounting and driving the curb surface brush.

SUMMARY OF THE INVENTION

In a mobile apparatus for cleaning snow and trash off a roadway, or the like, an electric resistance heating unit is helically disposed adjacent the bottom and inside wall of the tank with current being supplied by an alternator operated by the engine of the apparatus. Air contained by the tank is circulated through tubes overlying the tank and communicating, at its respective ends, with the interior thereof by a fan induced forced air flow through a resistance heater contained by the respective tube. The outlet end of each tube and the tank inlet port receiving snow discharged into the tank is opened and closed by hydraulically operated panels mounted on the top wall of the tank. A butterfly valve, contained by a vent in the tank top, is opened and closed by pressure and gravity respectively. The tank contains a quantity of water to be maintained above freezing temperature by the tank heating means.

The principal objects of this invention are to provide electric resistance heating units for circulating and heating air contained by the tank of a snow pickup and melting apparatus and providing hydraulically operated sliding members for closing tank openings thereby isolating the resistance heaters for protection when not in operation as well as conserving heat energy generated within the tank when not depositing snow in the disposal tank.

DESCRIPTION OF THE PREFERRED EMBODIMENTS

Figure 1:
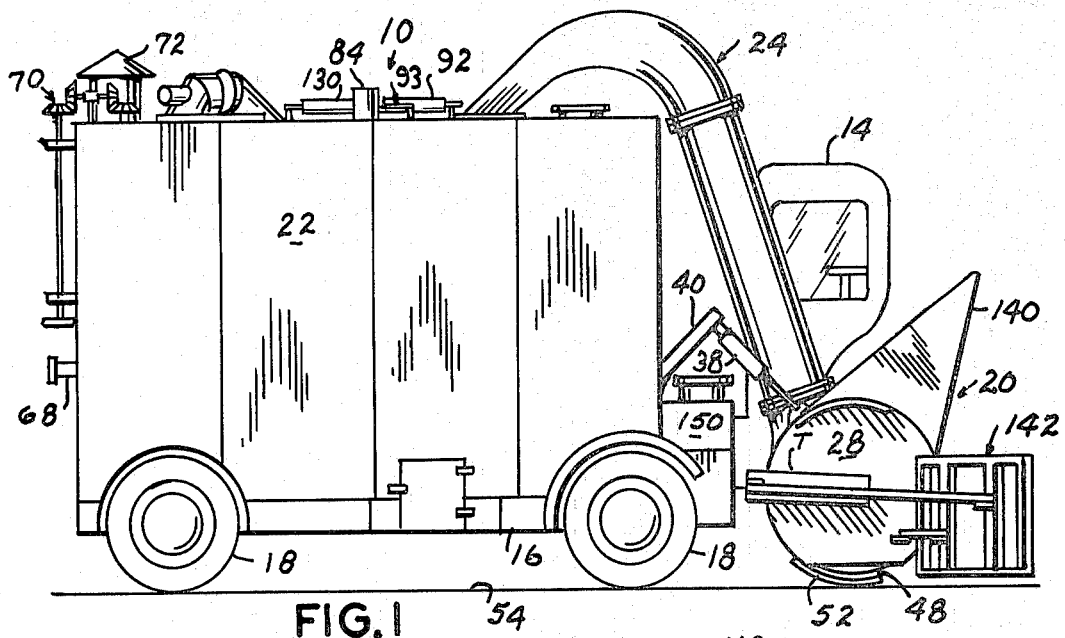
FIG. 1 is a side elevational view of the snow cleaning apparatus.
Figure 6:
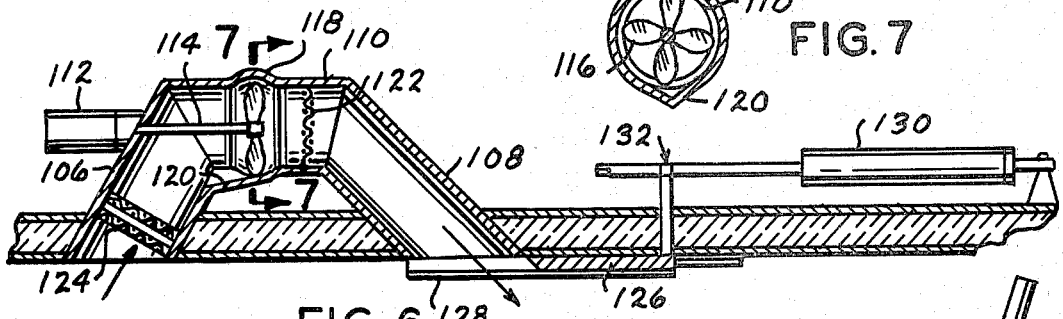
FIG. 6 is a fragmentary vertical cross sectional view, to another scale, taken substantially along the line 6—6 of FIG. 2.
Figure 7:
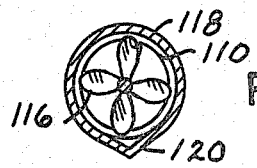
FIG. 7 is a vertical cross sectional view taken substantially along the line 7—7 of FIG. 6.
Figure 2:
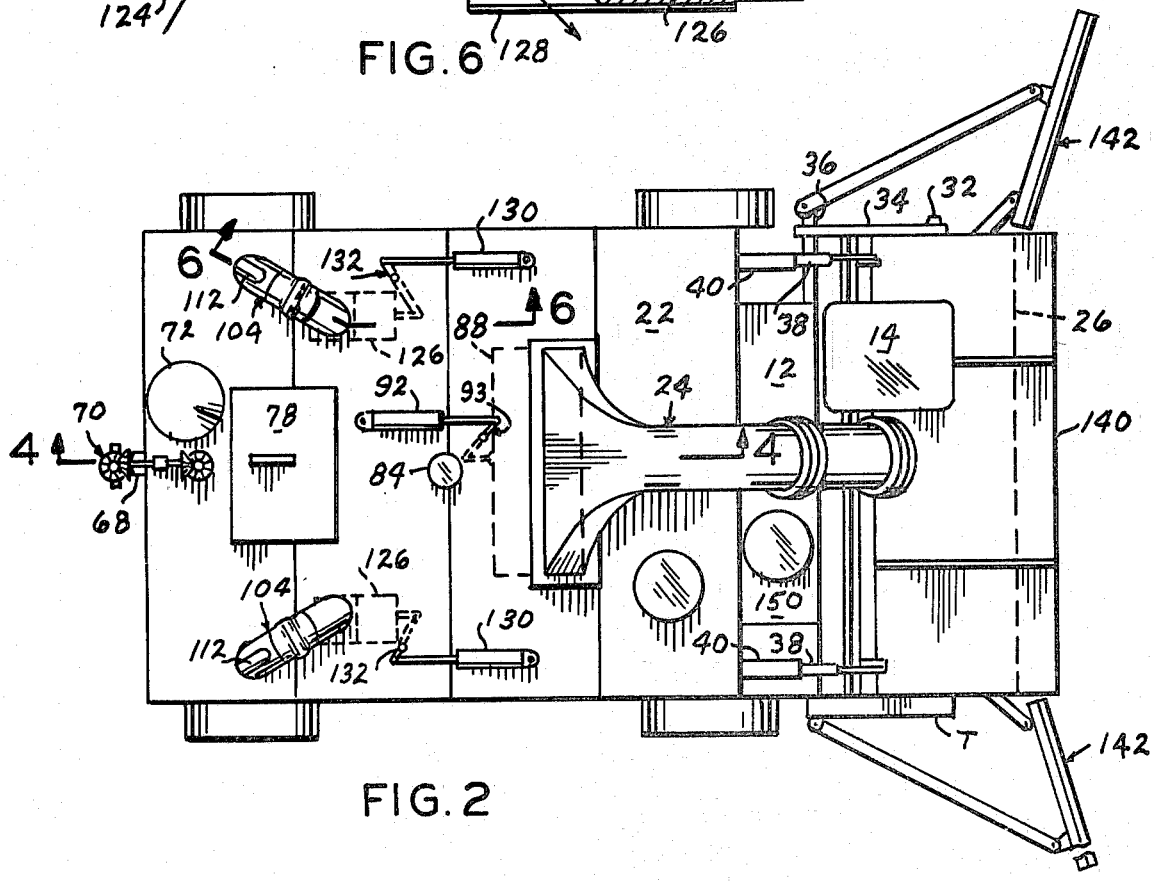
FIG. 2 is a top view of FIG. 1.
Figure 4:
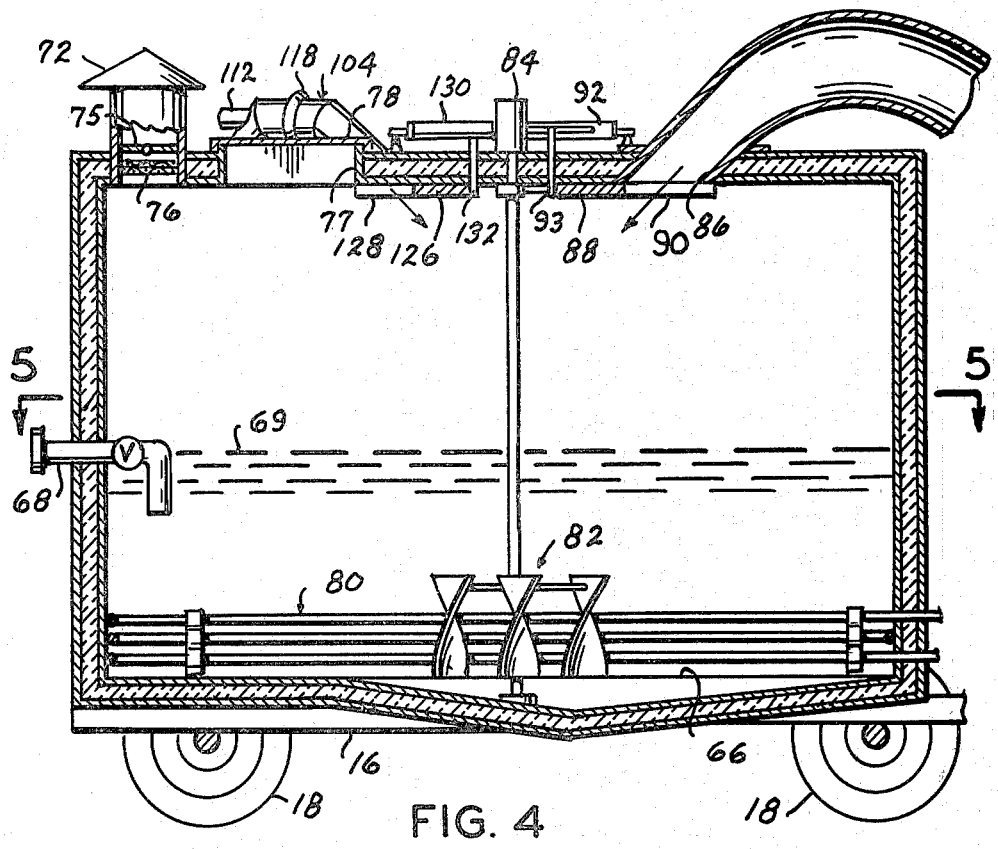
FIG. 4 is a vertical cross sectional view, to a larger scale, taken substantially along the line 4—4 of FIG. 2.
Figure 3:
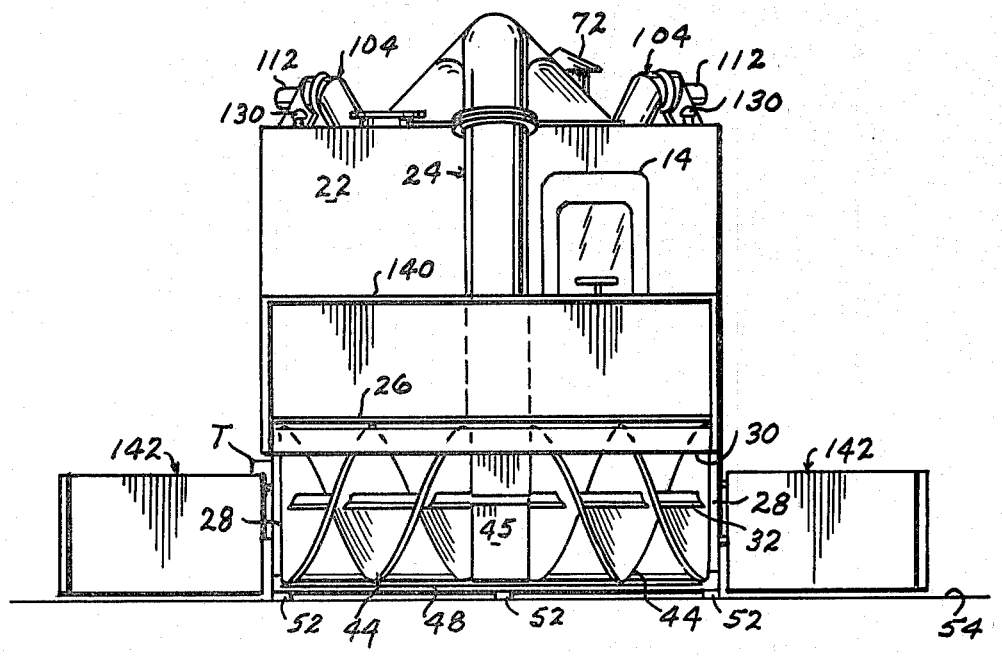
FIG. 3 is a front end elevational view.
Figure 5:
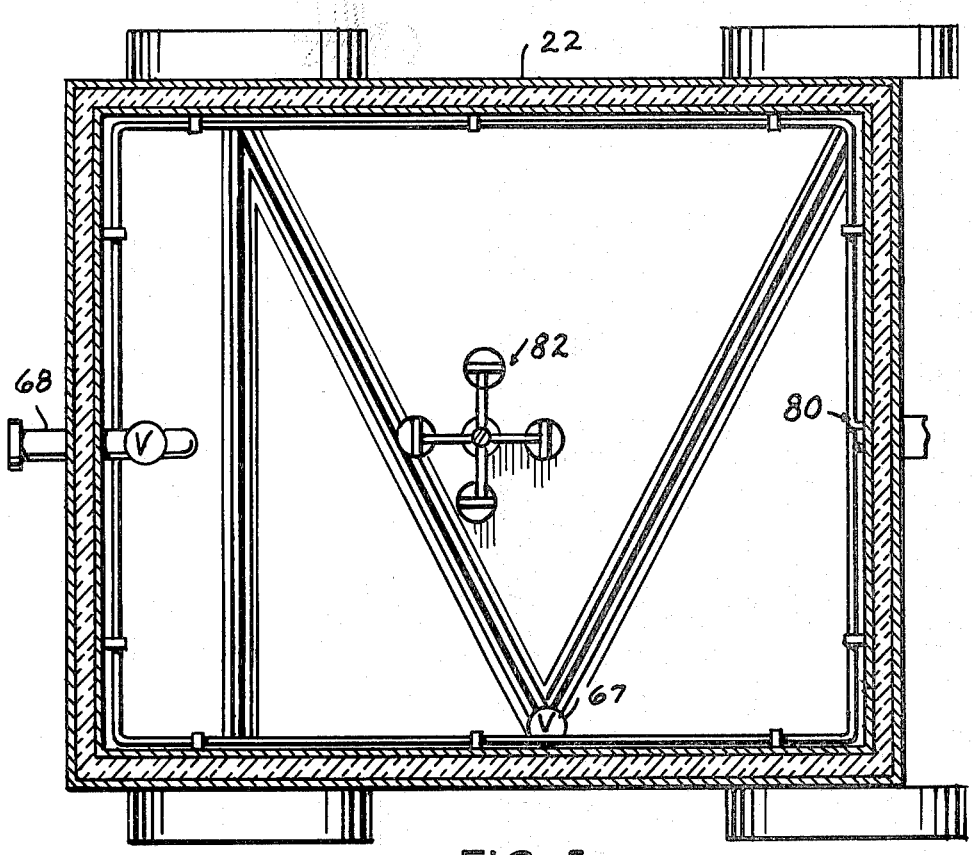
FIG. 5 is a horizontal cross sectional view taken substantially along the line 5—5 of FIG. 4.
Figure 8:
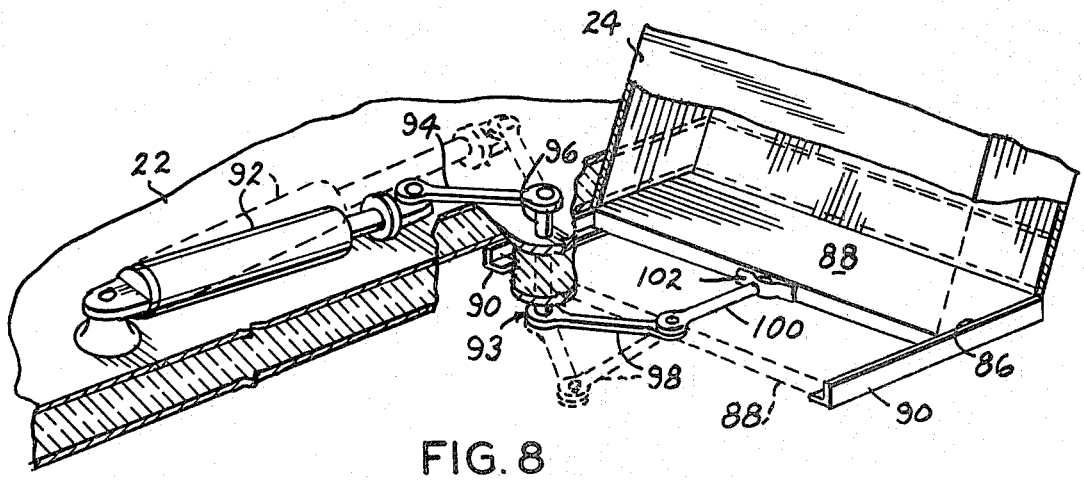
FIG. 8 is a fragmentary perspective view, partially in section, illustrating the hydraulic controls for opening and closing the tank snow inlet port.

Like characters of reference designate like parts in those figures of the drawings in which they occur.

In the drawings:

Referring more particularly to FIGS. 1 to 8, the reference numeral 10 indicates a substantially conventional truck chassis having an engine 12, a hydraulic pump and other conventional controls, not shown, and a control cab 14, mounted on and supported by the forward end portion of longitudinally extending vehicle frame members 16, in turn supported by wheels 18. Conveyor means 20 is mounted on the forward end of the chassis and connected with tank means 22, mounted on the chassis rearwardly of the cab, by flexible tube means 24. The conveyor means 20 comprises a substantially cylindrical horizontal housing 26 having end members 28 and having a portion of its forwardly and downward arcuate wall removed to form a snow and trash admitting opening 30. A conveyor shaft 32 extends horizontally between and beyond the ends 28 and is journalled at one end portion by the end portion of an arm 34. The other end portion of the arm 34 is pivotally connected to the outwardly disposed end portion of a support shaft 36 transversely supported by the chassis. The other end of the conveyor shaft 32 is attached to a transmission means T drivably connecting the engine 12 to the conveyor shaft 32 so that the housing 26 may be vertically pivoted about the horizontal axis of the shaft 36 as presently explained.

A pair of hydraulic cylinders 38 are connected, respectively, to a pair of parallel braces 40 which projects forwardly and upwardly in rearward spaced relation with respect to the housing 26. The piston end of the cylinders 38 are respectively pivotally connected to the upper surfaces of the housing 26 for raising and lowering the housing. Valve and tubing means, not shown, connected with the hydraulic system of the truck and the cylinders 38, are actuated by the operator in the control cab 14 for operating the cylinders 38 and raising and lowering the conveyor means 20. Oppositely acting screw conveyors 44, secured to the shaft 32, are each connected with an impeller blade 45 radially connected to the shaft 32 medially the length of the housing. The depending edge portion of the housing forms a pickup blade 48 extending longitudinally of the housing 26. A plurality of forwardly extending sled-like runners 52 are transversely secured, in spaced relation, to the lower limit of the housing pickup blade portion 48 for engaging the roadway or surface of the earth, indicated by the line 54, to prevent damaging the pickup blade 48. The conveyor shaft 32 forms a drive shaft for rotating the conveyors 44.

The tank means 22 includes a substantially rectangular double wall heat and cold insulated tank with an insulating coat, not shown, covering its inner surface and having a bottom wall 66 characterized by a sloping or inclined surface forming a sump at one side of the tank for completely draining the tank by a drain valve 67. A drain valve equipped drain pipe 68 extends through the rear wall of the tank in spaced relation above the tank bottom wall 66. The inward end of the pipe is turned downwardly below the normal level of water 69 contained therein to prevent draining floating snow. The rearward drain valve is manually opened and closed by a control means 70 supported rearwardly of the tank means 22. Vent 72 communicates with the tank through an opening formed in its top. A gravity actuated butterfly valve 75 normally closes the vent. Screens 76 transversely intersect the vent opening below the butterfly valve 75. A manhole 77, similarly formed in the top of the tank, is closed by a lid or cover 78.

An electric resistance heating element 80 is helically disposed in relatively close spaced relation above the upper limit of the tank bottom wall 66 adjacent the inside surface of the tank. Current for the heater element 80 and other heating elements to be presently described is supplied by an alternator, not shown, operated by the engine 12.

Agitator means 82 is centrally mounted on a vertical shaft within the tank 22 and driven by a hydraulic motor 84 mounted on the top of the tank for mixing snow or other materials, not shown, deposited in the tank.

The exhaust end of the tube means 24 is connected with the tank top through an elongated rectangular inlet port or opening 86 which may be closed for heating the tank contents. A planar door 88 is slidably supported, adjacent the depending surface of the top wall, by a pair of rails 90 connected therewith for fore and aft sliding movement of the door 88 in an opening and closing action of the inlet port 86. This opening and closing action is accomplished by an inlet port hydraulic cylinder 92 pivotally mounted on the tank top and having its piston connected with link means 93 attached to the door 88. The link means 93 comprises an arm 94 connected with a vertically disposed shaft 96 extending through the tank top wall and connected with one end of another arm 98 in turn connected at its other end with a link 100 pivotally attached by a ball joint 102 to the adjacent edge of the door 88 thus, as shown by solid and dotted lines in FIG. 8, extension and retraction of the hydraulic cylinder piston moves the door in a port opening and closing action.

A pair of return bend type tubes 104 are mounted on the top wall of the tank. Each of the tubes 104 comprise an angularly disposed inlet end portion 106 and an angularly disposed outlet end portion 108 respectively communicating with the interior of the tank through suitable openings formed therein with these end portions being joined together by an intermediate horizontal portion 110. A hydraulic motor 112, mounted on each tube inlet portion 106, has its shaft 114 coaxially disposed within the horizontal portion 110 and connected with fan blades 116 describing a circle, when rotating, substantially equal with the inside diameter of the tube portion 110 and transversely intersecting its bore. At the position of the fan blades 116, the tube portion 110 is diametrically enlarged, as at 118, a distance at least equal to twice the thickness of the tube wall to accommodate the fan blades and collect moisture condensing or precipitating out of air drawn into the tube from the tank by the fan. The depending portion of the tube portion 110 wall is upset or struck out to form a V-shaped groove 120 (FIG. 7) for draining collected moisture into the tube portion 106. Obviously more than one fan 116 may be mounted on the shaft 114 for collecting and draining excess moisture.

An electric heating element 122 is transversely disposed within the tube portion 110 forwardly of the position of the fan blades 116 for heating air contained by the tank when drawn through the tube 104 in the direction of the arrows. The tube inlet portion 106 contains transversely disposed filter screens 124 which would dissipate snow and moisture.

The tube outlet end portion 108 is opened and closed by a sliding panel 126 slidably supported by rails 128 for movement in a fore and aft direction. The panel opening and closing action is accomplished by panel tank top mounted hydraulic cylinders 130 similarly connected with the respective panel by pivoting linkage 132 arranged in the manner identical to that described hereinabove for the inlet port door opening and closing linkage 93.

When the apparatus is used as a snowplow wherein snow drifts of considerable depth are encountered, a deflector or guide means 140 is connected with the conveyor housing 26. The guide means 140 comprises of a sheet metal panel which longitudinally contacts the upper surface of the housing wall and is inclined upwardly and forwardly therefrom. When the apparatus is moved forwardly the guide means 140 thus deflects drifted snow downwardly and rearwardly toward the housing opening 30. The snow pickup area of the conveyor portion 20 may be increased laterally by a pair of wing panels 142 connected with and supported by the opposite ends of the conveyor.

Figure 9:
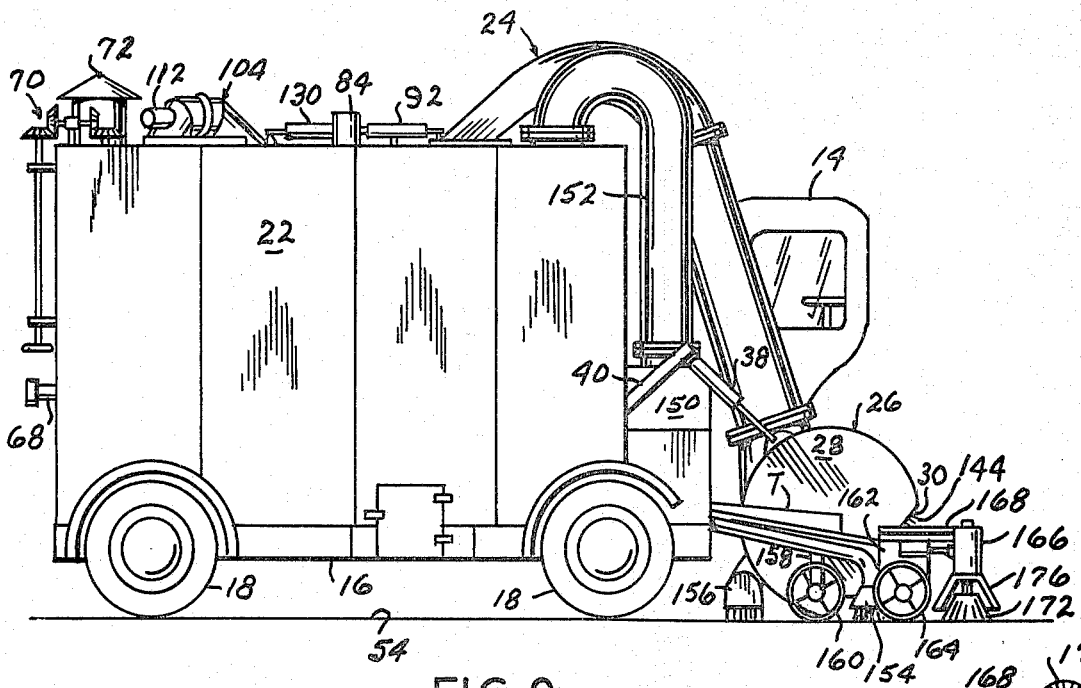
FIG. 9 is an elevational view similar to FIG. 1 illustrating the cleaning apparatus when modified for dirt and trash pickup; and, FIG. 10 is a top view of FIG. 9.
Figure 10:
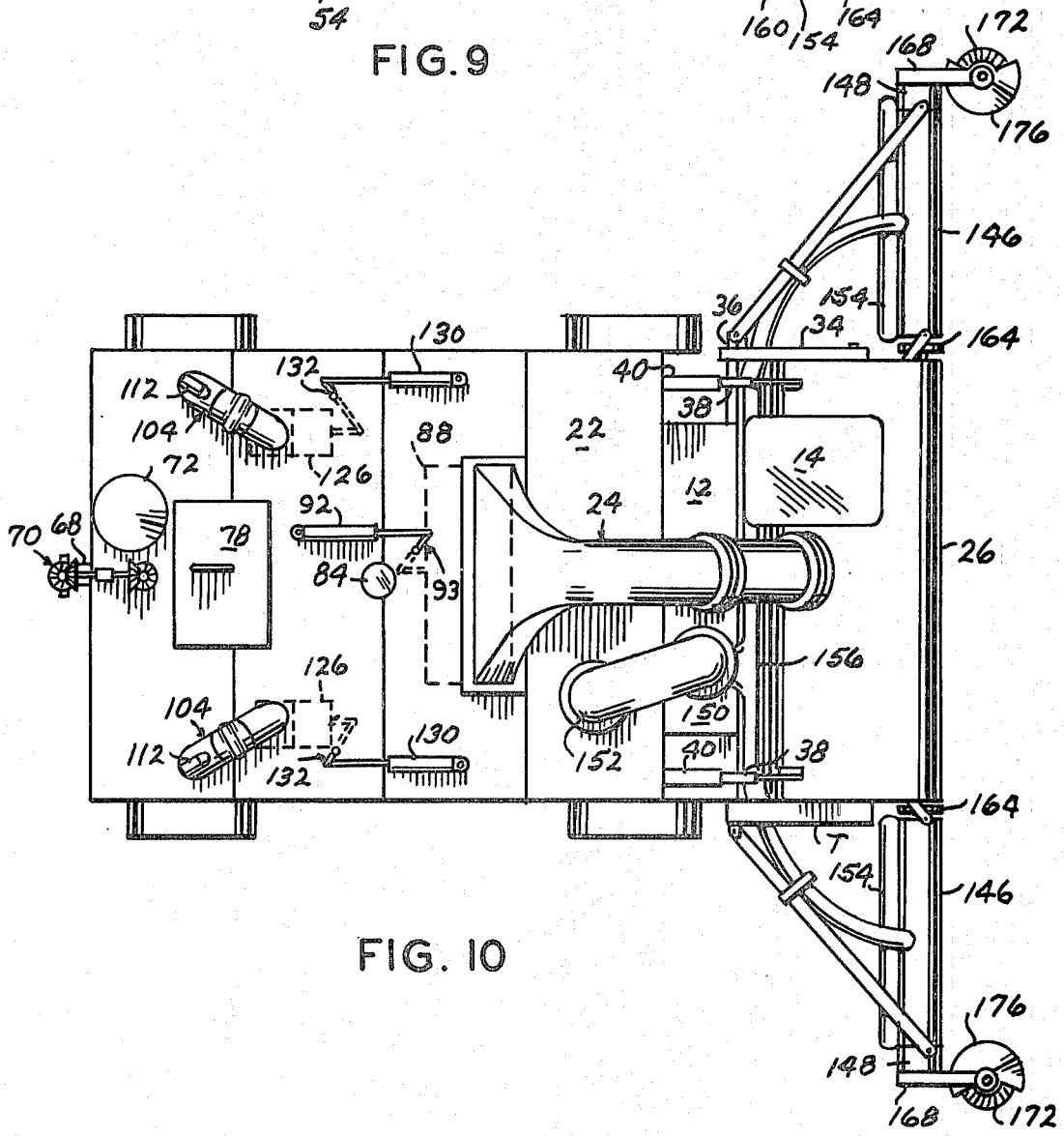

Referring more particularly to FIGS. 9 and 10, a modified form of the cleaning apparatus is disclosed for a sweeping and cleaning action of the roadway, or the like, in which brushes 144 are connected with the conveyor blades 44 for picking up dry material and depositing it in the tank through the tube means 24. This sweeping and cleaning action may be extended laterally by connecting brush equipped conveyors 146 to the respective end portion of the conveyor housing 26. The brush conveyors 146 are driven by brush conveyor hydraulic motors 148.

Vacuum means 150 is connected with the tank by a flexible discharge tube 152. The vacuum means 150 is connected with suction chambers 154 coextensively disposed rearwardly of the respective brush conveyor 146. A third vacuum unit 156 is similarly disposed rearwardly of the conveyor housing 26.

The conveyor protective runners 52 are removed and a pair of generally upright support arms 158 are adjustably connected by bolts to the respective end walls 28 of the conveyor housing 26 and project downwardly beyond the cylindrical plane of the housing. The depending end portion of the arms 158 journal a first pair of wheels 160 for the purpose of contacting the roadway surface 54 and maintaining a desired minimal clearance between the conveyor 20 and the roadway surface.

Similarly, other pairs of support arms 162, similar to the arms 158, are adjustably connected, respectively, with the inwardly disposed end of each brush conveyor 146 and outermost end surface of the hydraulic motors 148. Second pairs of wheels 164 are journalled by the respective support arms 162.

Curb brush units 166 are connected with the outermost ends of the brush conveyors 146 for cleaning trash and dirt adjacent the curb or lateral edges of roadways not ordinarily cleaned. To accomplish this the support arms 162 are extended upwardly above the horizontal limit of the respective brush conveyor and a forwardly projecting brace 168 is connected thereto. A tubular housing is vertically connected in depending relation with the forward end of each brace 168. The housing vertically journals a spring urged splined shaft having a brush 172 connected with its depending end. Bevel gears, not shown, connect the splined shaft with a hydraulic brush motor mounted on the respective arm 164 for rotating the brushes and directing dirt or debris toward the brush conveyors 146. Shields 176 overlie a portion of the brushes 172 to minimize blowing dust.

OPERATION

Operation of the apparatus seems obvious but briefly stated, when picking up snow the tank 22 preferably contains water 69 and electric energy is supplied to the heating coil 80 to maintain the temperature of the water at least above freezing. The agitator 82 is operated to mix and melt the snow with the water.

When the water or slurry in the tank reaches a desired temperature, current to the tank heating coil 80 is interrupted and applied to the resistance heaters 122 within the air circulating tubes 104. Air drawn through the tubes 104 is heated and directed toward snow entering the tank through the inlet port 86. Electric energy required for the blower heater coils 122 for melting snow and maintaining the desired temperature in the tank is considerably less than that required by the tank heating coil 80 for removing snow without the foregoing. The elevated temperature of the air in the tank melts the snow without steaming. Circulating air with the blower heaters would not cause an accumulation of air pressure. As snow is propelled through the air by the throwing action of the pickup auger rather than by air pressure, the build-up of air pressure in the tank would be insignificant. In the event air pressure within the tank exceeds atmospheric pressure, the butterfly valve 75 opens to release it.

Trash may also be picked up with or in lieu of snow and mixed with water to form a slurry for disposal through the drain pipe 68. In warm months of the year the brush members 144–146, vacuum chambers 154–156, support wheels 160–164 and curb brush units 166 are installed and used for picking up debris by a brushing and vacuuming action wherein the dry material is collected and mixed with water to form a slurry for removal to a place of disposal.

Obviously the invention is susceptible to changes or alterations without defeating its practicability. Therefore, I do not wish to be confined to the preferred embodiment shown in the drawings and described herein.

I claim:

1. In a roadway cleaning apparatus including an engine mounted on a vehicle chassis having an upright tank thereon, rotatable screw conveyor means including a horizontal conveyor housing having a snow pickup helical conveyor disposed horizontally within and journalled by the conveyor housing adjacent the surface of a roadway at the forward end of the chassis, tubing means connecting said screw conveyor means with an inlet port in the top of the tank for discharging snow thereinto, an engine operated control means including an engine driven hydraulic fluid pump and a hydraulic conveyor driving motor drivably connected with said helical conveyor and an electric current generating means, the improvement comprising:

means for maintaining the interior of said tank at a desired temperature, said means including a return bend tube having an intermediate portion and having end portions communicating with the interior of said tank through openings formed in one of its walls, means for forming a forced air draft of a portion of the air contained by said tank through said return bend, and means for heating the forced draft of air;

sliding panel means for opening and closing one said tube end portion; and, means for moving said sliding panel means.

2. The combination as set forth in claim 1 in which said means for forming said forced air draft includes:

a fan within said tube intermediate portion; and, a hydraulic fan motor having its drive shaft drivingly attached to said fan.

3. The combination as set forth in claim 2 in which said tube intermediate portion is diametrically enlarged intermediate its ends to form a moisture collecting recess and in which the tube intermediate portion has a portion of its wall struck out to form a groove communicating with the recess for draining collected moisture into the other said tube end portion.

4. The combination as set forth in claim 3 in which said forced air heating means includes:

an electric resistance heating unit disposed within said return bend tube downstream from said fan.

5. The combination as set forth in claim 4 in which said sliding panel means includes:

a planar panel flatly disposed adjacent the surface of said tank wall opposite said return bend tube; and, panel supporting rails secured in parallel spaced relation to said tank wall surface for slidably supporting said panel.

6. The combination as set forth in claim 5 in which said panel moving means includes:

a panel hydraulic cylinder mounted on said tank wall; and, pivoting linkage supported by said tank wall connecting the piston of said panel hydraulic cylinder with said panel.

7. The combination as set forth in claim 6 and further including:

filtering means transversely intersecting the bore of said tube other end portion.

8. The combination as set forth in claim 7 and further including:

a planar sliding door for opening and closing said tank inlet port;

door supporting rails secured in parallel spaced relation to said tank top for slidably supporting said door;

a door operating hydraulic cylinder mounted on said tank top; and, other pivoting linkage supported by said tank top and connecting the piston of said door hydraulic cylinder with said door.

9. The combination as set forth in claim 8 in which said tank is provided with a vent, and further including:

a butterfly valve pivotally intersecting the vent and normally gravity biased to vent closed position, said butterfly valve being biased toward vent opened position by above atmospheric pressure in said tank.

* * * * *